United States Patent [19]

Takase

[11] 4,133,991

[45] Jan. 9, 1979

[54] LIMIT SWITCH

[75] Inventor: Yosio Takase, Sakura, Japan

[73] Assignee: Matsushita Electric Works, Ltd., Osaka, Japan

[21] Appl. No.: 837,036

[22] Filed: Sep. 27, 1977

[30] Foreign Application Priority Data

Sep. 27, 1976 [JP] Japan ..... 51-116286

[51] Int. Cl.[2] ..... H01H 19/32

[52] U.S. Cl. ..... 200/47

[58] Field of Search ..... 200/47, 302, 303

[56] References Cited

U.S. PATENT DOCUMENTS

| | | | |
|---|---|---|---|
| 3,100,824 | 8/1963 | Charbonneau | 200/47 |
| 3,578,932 | 5/1971 | Holmes | 200/47 X |
| 3,649,785 | 3/1972 | Dietrich | 200/47 |

*Primary Examiner*—Donald F. Norton

*Attorney, Agent, or Firm*—Burns, Doane, Swecker & Mathis

[57] ABSTRACT

A motion detecting limit switch minimized in size and still easy to assemble respective parts and to connect lead wires to contactor terminals is provided. The switch comprises a switch unit including switch over contactors and a head unit including a rotatable actuator arm for converting actuator displacements into switch actuating movements. The switch unit is accommodated in a housing comprising a base body widely opened with side walls of reduced height allowing free access to the contactor terminals of the switch unit secured in the base body, except an end wall of larger height to which the head unit is mounted, and a lid formed with an electrically insulative material in a shape complementary to the reduced height side walls of the base body for fitting over the switch unit. A cylindrically extended mounting part of the head unit including transmitting means of the converted switch actuating movements to the switch unit is axially rotatably fitted in an aperture in the end wall of the base body to have the transmitting means opposed contactor actuating rod of the switch unit. A resilient means holds the mounting part of the head unit in position in the rotatable manner while simultaneously securing the switch unit firmly in position inside the base body.

4 Claims, 6 Drawing Figures

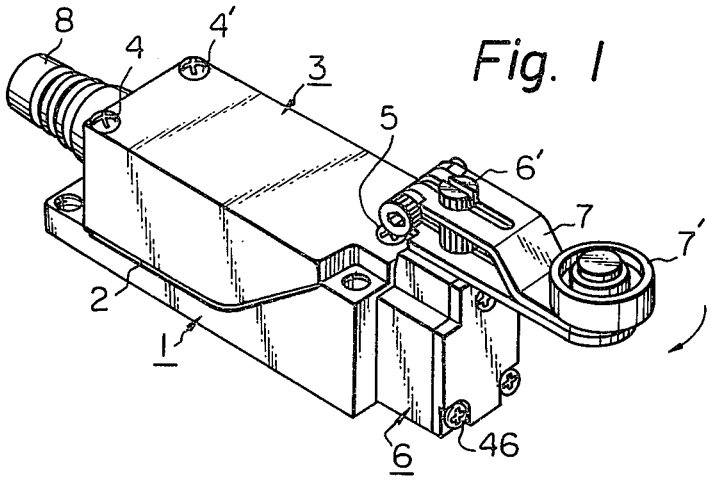
Fig. 1
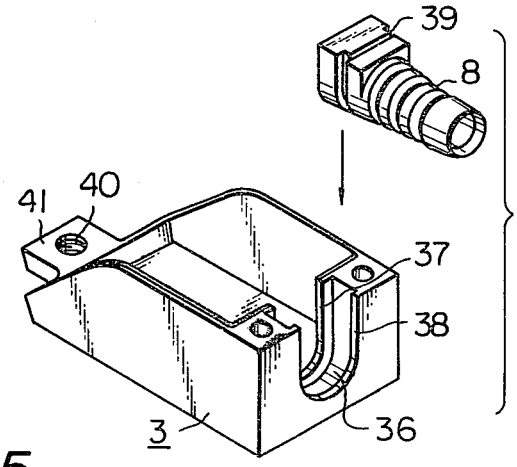
Fig. 3
Fig. 5
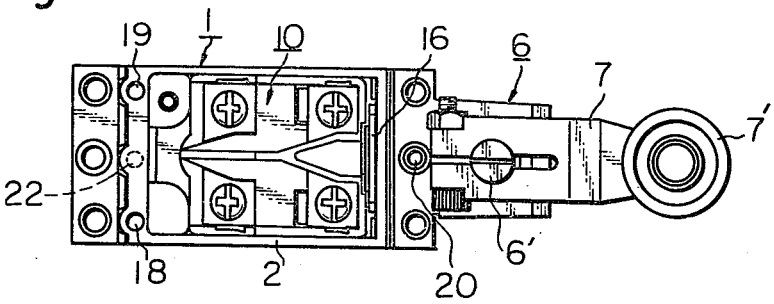

LIMIT SWITCH

This invention relates to limit switches and, more particularly, to improvements in limit switches which detect motions of a movable part of an associated machine to open and close electric contacts of the switches.

Generally, in the limit switch of the type referred to, it is necessary to connect terminals of a switch unit housed in a sealed type housing with lead wires to be led out of the housing, and there are two types of wire connecting systems, one of which is plug-in type and the other of which is direct wire connecting type of the switch terminals with the lead wires.

Referring to technical background of this kind of limit switch, as suggested in, for example, U.S. Pat. No. 3,578,932, the switch is fixed to the bottom part of a housing opened only on one side and, therefore, the operation of connecting the lead wires with the switch terminals is carried out within an extremely limited open space of the housing and has been disadvantageous in respect of the reliability and quickness. If a sufficient open space was attempted to be provided, any measure therefor has had to result in a larger size of the housing.

Further, in the limit switch of the kind referred to, as in the above U.S. patent, for example, the switch is fitted to the housing by means of screws and, therefore, in order to secure an enough space for screw driving, a sufficient inside space of housing interior has been required.

Also in the limit switch of the kind referred to, an actuator member for converting an external force into a displacing motion for operating the switch is fixed to the housing by means of screws as also shown in the U.S. patent and, therefore, an enough screw driving space also has had to be secured in the housing interior.

Further, the housing and an upper lid for closing its opening are both formed generally of a die-cast conductive material, as also seen in the U.S. patent. Accordingly a clearance between the switch terminals and the upper lid has had to be provided sufficiently for achieving an effective electric insulating distance, whereby the housing interior has had to be of a sufficient size.

The present invention has been suggested in view of these inconveniences in the conventional limit switches and provides a limit switch wherein lead wires can be connected to the switch unit in a sufficiently large space, no screw is required to fix the switch unit and actuator member to the housing, further the upper lid closing the opening of the housing can be formed of an electric insulating material so as to minimize the clearance between the switch terminals and the housing, whereby the volume can be made to be about half that of the conventional limit switches.

A primary object of the present invention is, therefore, to provide a limit switch minimized in size.

Another object of the present invention is to provide a limit switch which is easy to perform lead wire connection.

A further object of the present invention is to provide a limit switch wherein the switch unit requires no screws for fitting it to the housing and thus assembling work of the entire switch is simple and easy.

Yet another object of the present invention is to provide a limit switch having a water-proof structure.

Other objects and advantages of the present invention shall be made clear in the following disclosure of the invention detailed with reference to accompanying drawings, in which:

FIG. 1 is a perspective view of an embodiment of the limit switch according to the present invention, wherein a switch actuating head unit is shown in one of a plurality of selective fitting positions to a housing including a switch unit;

FIG. 3 is a disassembled perspective view of an upper lid and a bushing to be fitted to the lid of the limit switch shown in FIG. 1 but as seen from the reverse side;

FIG. 5 is a plan view showing the switch unit and housing base body as assembled of the limit switch shown in FIG. 1 with the upper lid removed.

Figures 2, 4A, 4B:
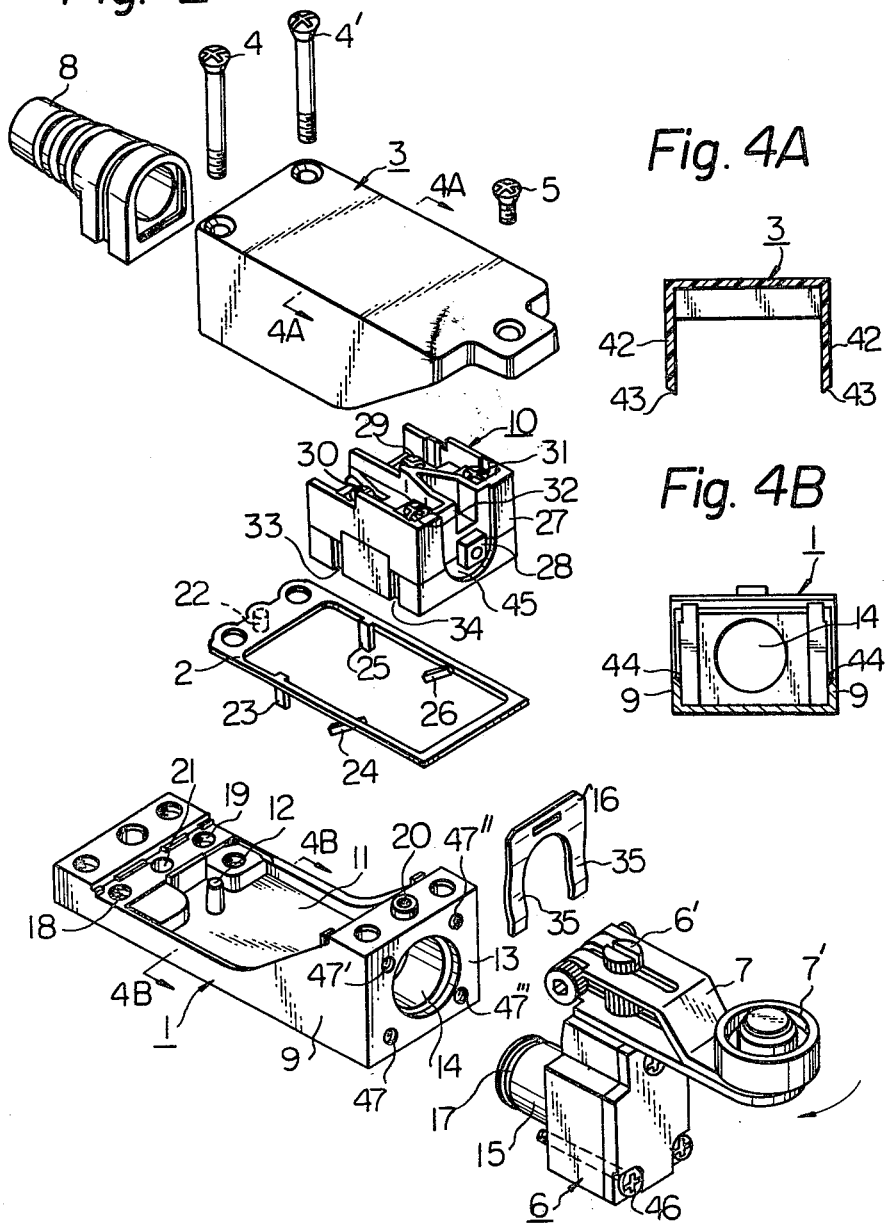
FIG. 2 is a perspective view of respective parts as disassembled of the limit switch of FIG. 1.
FIG. 4A is a sectioned view of the upper lid along line 4A—4A in FIG. 2.
FIG. 4B is a sectioned view of the housing base body along line 4B—4B in FIG. 2.

Referring now to FIG. 1 of a preferred embodiment of the present invention, a switch unit 10 (see FIG. 2 or 5) is housed in a housing base body 1, and an upper lid 3 is fitted to the base body 1 through a packing 2 and fixed thereto by means of screws 4, 4' and 5. A head unit 6 for detecting the motion of an associated machine or the like (not shown) and converting a displacement of an actuator arm 7 to a switch operating displacement is secured to a side part (a longitudinal end in the embodiment) of the base body 1. The actuator arm 7 is fixed at its part adjacent one end to a rotary shaft 6' projecting from the head unit 6 and provided at the other end with a roller 7' which abuts a movable part of the associated machine that has reached mounted position of the limit switch so that, in the case of the illustrated embodiment, the actuator arm 7 will be rotated with the shaft 6' by the movable machine part and the shaft 6' will be thus rotated. A bushing 8 elastically and water-tightly holding electric wire cord (not illustrated) for connecting the switch unit with an electric device to be controlled by the limit switch is fitted at one end thereof to a longitudinal end of the upper lid 3 (see also FIG. 3).

Referring to FIG. 2, the housing base body 1 is an integral die-cast member and its both side walls 9 are formed to be low in the part of inserting the lead wires of the electric wire cords, that is, on the side of the bushing 8 of the upper lid, and to be high on the side to which the head unit 6 is coupled, so as to provide slopes intermediately between them. Further, a cavity 11 for fitting the switch unit 10 is formed within the base body 1. A boss 12 for fitting the switch unit 10 is formed in a part of the cavity 11. A hole (not illustrated) to receive the boss 12 is formed on the bottom of the switch unit 10. A cylindrical aperture 14 for fitting the head unit 6 is formed on an end wall 13 in the longitudinal direction and contiguous to the side walls 9. Further, the base body 1 is provided with threaded holes 18, 19 and 20 for fixing the upper lid and with a hole 21 for receiving a fitting projection 22 made on the lower surface of the packing 2.

The head unit 6 has a substantially cylindrical mounting part 15 formed on an end surface facing the end wall 13 of the base body 1. A ring-shaped groove 17 is provided adjacent tip end of the mounting part 15 for engaging therein both legs of a clip 16 for resiliently hold the mounting part 15 rotatably about its axis to the end wall 13 of the base body 1. A cylinder (not illustrated) having a plunger operatively coupled to the rotary shaft 6' through a rotation-to-linear motion converting means within the head unit 6 and projected and retracted in response to the rotation of the shaft 6' is contained in the center of the mounting part 15 so that the plunger will be pushed out toward the switch unit 10 by the rotation of the shaft 6' given through the actuator arm 7. The head unit 6 is provided further with a screw 46 inserted through a corner of the unit so that, when the head unit 6 is fitted to the housing body 1, tip end of the screw 46 will be selectively inserted into one of holes 47, 47', 47'' and 47''' made on the periphery of the cylindrical aperture 14 of the body 1 as spaced by an angle of 90° with respect to the axis of the hole 14, so as to be able to fix the head unit 6 in any desired position to the housing base body 1.

The packing 2 is made of an elastic material and provided with a substantially rectangular wide open frame rib which abuts the peripheral edge part of the cavity 11 of the body 1 and, on both side parts of the rib, with four fitting legs 23 to 26 for fitting the packing to the switch unit 10.

The switch unit 10 comprises switch contacts built within a two-split case 27 made of plastics and an actuating rod 28 for switching over the contacts and normally biased to project at one end out of the case 27 so that, when the plunger of the head unit 6 pushes the actuating rod 28 the contacts will be switched. Numerals 29 and 31 indicate terminals of the switch contacts for connecting lead wires. Further, grooves 33 and 34 for fitting the fitting legs 23 to 26 of the packing 2 are formed on the side walls of the case 27.

The clip 16 for fixing the head unit 6 to the housing base body 1 as described above is U-shaped and curved part 35 is formed the respective legs so that, when the clip 16 is inserted in the groove 17 of the mounting part 15 of the head unit 6 disposed between a side wall of the casing 27 of the switch unit 10 fitted within the base body 1 and the inside surface of the end wall 13 of the base body 1, it will elastically hold the mounting part 15 of the unit 6 in position while tightly fixing the respective parts.

The upper lid 3 is preferably made of an electrically insulating material so as to be box-shaped and is provided with an aperture 36 (see FIG. 3) for fitting the bushing 8 on an end wall and with flanges 37 and 38 on both side edges of the aperture 36. On the other hand, a fitting groove 39 is formed in the base part of the bushing 8 for receiving the flange 37 when fitted to the lid. Further, in the upper lid 3, an extended part 41 provided with a threaded hole 40 to insert the screw 5 is formed on the side opposite to the part for mounting the bushing.

Referring next to FIGS. 4A and 4B, the upper lid 3 has a tapered edge 43 sloped downward from the outside to the inside at the lower end of each of side walls 42, whereas the housing base body 1 has a tapered edge 44 sloped downward from the outside to the inside on each of side walls 9. Thus, in assembling them, the packing 2 is interposed between both tapered edges 43 and 44 to establish a water-proof structure.

The assembly of the switch of the present invention shall be explained in the following.

The bushing 8 is inserted at its base part into the aperture 36 of the upper lid 3 so that the flange 38 of the upper lid 3 will fit in the groove 39 of the bushing 8. Then, the respective fitting legs 23 to 26 of the packing 2 are inserted into the respective grooves 33 and 34 of the switch unit 10. At this time, as the legs 24 and 26 are inclined with respect to the plane of the packing, the rib of the packing 2 will resiliently curve to be along the slope of the side walls 9 of the housing base body 1 when the legs are inserted into the grooves 34. The packing 2 thus fitted around the switch unit 10 is mounted on the upper surfaces of the side walls 9 of the base body 1 when the switch unit 10 is inserted into the cavity 11 of the base body 1. In this case, the hole on the lower surface of the switch unit 10 will fit over the boss 12 on the inside surface of the base body 1.

Then the cylindrical mounting part 15 of the head unit 6 is inserted into the cylindrical aperture 14 of the housing base body 1 so as to fit in a recess 45 of the end surface of the switch unit 10. In this case, the actuating rod 28 of the switch unit 10 will be positioned in axial opening at the tip of the mounting part 15 of the head unit 6. The clip 16 is then fitted between the inside wall of the end wall 13 of the base body 1 and the end surface of the switch unit 10, the both legs of the U-shaped clip 16 will engage resiliently in the groove 17 of the mounting part 15 with the curved parts 35 of the clip 16 urging the mounting part 15 to be pulled inside the base body 1 while pushing the casing 27 of the switch unit 10 in reverse direction to the head unit 6. Accordingly the switch unit 10 will be tightly secured within the housing base body 1 while the head unit 6 is also held in its mounted position to the base body 1, as seen best in FIG. 5. The electric wire cords not shown are inserted into the bushing 8 and the tips of their lead wires are exposed and are connected respectively to the terminals 29 to 30 of the switch unit 10.

The upper lid 3 is then mounted over the base body 1 including the switch unit 10, and the screws 4, 4' and 5 are screwed into the respective corresponding threaded holes 18, 19 and 20 of the body 1, whereby the upper lid 3 is secured to the base body 1. In this structure, the head unit 6 is freely rotatable with the mounting part 15 as an axis with respect to the base body 1 and, therefore, the head unit 6 as well as the actuator arm 7 can be fitted, in the present instance, at any one of the four rotary positions by fitting the screw 46 in any of the four threaded holes 47, 47', 47'' and 47''' of the housing base body 1.

Now, the usage of the limit switch of the present invention shall be briefly explained. When the actuator arm 7 is rotated in or against the direction indicated by the arrow in FIG. 1, the plunger contained in the mounting part 15 will be projected by the rotation of the rotary shaft 6' of the head unit 6, the actuating rod 28 of the switch 10 will be thereby pushed and the contacts in the switch unit 10 will be switched.

As the present invention is formed as described above, there are such effects that:

(a) In the case of fitting the switch unit in the housing comprising the base body and lid, the boss 12 provided within the housing will fit in the hole of the bottom of the switch unit, the cylindrical mounting part of the head unit will be inserted through the cylindrical aperture 14 of the housing body so as to engage in the recess of the side wall of the switch unit, whereby the switch unit can be firmly secured within the housing without using any screw and simultaneously the head unit can also firmly mounted to the housing. Therefore, it is not necessary to fix the head unit with any screws as has been required heretofore, the fitting space can be greatly reduced, the size of the limit switch can be made minimum and the number of the assembling steps can be reduced.

(b) As the side walls of the housing base body are made low on the lead wire introducing side (on the side opposite the head unit) and the switch unit is sufficiently opened above with respect to the lead wire connecting direction, it will be very easy to connect the lead wires to the terminals of the switch unit.

(c) As the upper lid of the housing is made of a synthetic resin, there is no problem of electric insulation between the terminals of the switch unit and the upper lid, so that any large clearance between the switch terminals and the upper lid for securing a sufficient insulating distance becomes unnecessary and it is possible to make the limit switch smaller as a whole.

(d) As the packing member is provided with a plurality of fitting legs so that the legs will be fitted in advance into the grooves of the casing of the switch unit in assembling the limit switch, it will be easy to assemble the packing member which is resilient and is generally apt to escape out of assembling position.

(e) As the tapered part from the outside toward the inside is made on the joining edges of each of the side walls of the upper lid and base body, the packing can be favorably secured in the position between such tapered edges.

(f) The clip is provided with the resiliency by means of the curved parts so that, when this clip is inserted between the casing of the switch unit and the inside wall of the housing base body, the casing of the switch unit will be pressed by the curved parts, so that the switch unit can be firmly secured within the housing base body.

What is claimed is:

1. A limit switch comprising a housing including a base body and a lid fitted over said base body, a switch unit housed in said housing said switch unit being fixed to said base body and said base body and lid being water-tightly sealed, and a head unit including an actuator, said head unit secured to the base body of the housing, said head unit operatively coupled to said switch unit for converting displacement of said actuator into switch actuating movements, said switch unit being disposed in the housing so as to expose its contactor terminals in open space when said lid is removed, the arrangement being such that side walls of said base body of the housing are formed to be lower at least on the side of leading out wire cords connected to said contactor terminals from the switch unit than the side on which the head unit is coupled to the base body, said body including a projection, said switch unit being secured against movement in one direction by engagement with said projection when said switch unit is installed in said body, said head unit including a mounting part inserted within said body, a resilient member arranged to secure said mounting part within said body while simultaneously exerting forces directed to secure said switch unit against movement in another direction.

2. A limit switch according to claim 1 wherein said mounting part of the head unit has a groove at a position disposed inside the base body when the head part is secured thereto, and said resilient member is inserted into said groove.

3. A limit switch according to claim 2 wherein said resilient member is a substantially U-shaped plate having two legs intermediately curved for providing a resiliency and inserted in said groove of the mounting part of the head unit.

4. A limit switch according to claim 1 wherein said switch unit is provided in side surfaces of its casing with a plurality of recesses, and a resilient packing means substantially of an endless shape and having a plurality of projections to be fitted in said recesses of the switch unit so that said packing means is fitted around said casing of the switch unit and is interposed between respective edges of side walls of said base body and lid when the switch unit is housed in the base body and the lid is fitted over the switch unit.

* * * * *